United States Patent [19]

Bullivant

[11] Patent Number: 4,840,517

[45] Date of Patent: Jun. 20, 1989

[54] SOIL DISPLACEMENT TOOLS

[75] Inventor: Roger A. Bullivant, Burton-on-Trent, England

[73] Assignee: Roger Bullivant of Texas, Inc., Grand Prairie, Tex.

[21] Appl. No.: 19,883

[22] Filed: Feb. 27, 1987

[30] Foreign Application Priority Data

Feb. 28, 1986 [GB] United Kingdom ..... 8605009

[51] Int. Cl.[4] ..... E02D 5/36

[52] U.S. Cl. ..... 405/241; 175/20; 175/21; 405/232; 405/240

[58] Field of Search ..... 405/154, 184, 174, 232, 405/233, 240, 241, 242; 175/20–24, 45, 53, 61, 62

[56] References Cited

U.S. PATENT DOCUMENTS

| | | | |
|---|---|---|---|
| 977,356 | 11/1910 | Withrow | 405/243 |
| 3,137,483 | 6/1964 | Zinkiewicz | 175/19 |
| 3,151,687 | 10/1964 | Sato et al. | 175/21 |
| 3,344,611 | 10/1967 | Philo | 405/240 |
| 3,420,067 | 1/1969 | Bjerking | 405/242 X |
| 3,465,834 | 9/1969 | Southworth | 405/184 X |
| 3,869,869 | 3/1975 | Paochen | 405/240 |
| 4,026,370 | 5/1977 | Foster et al. | 175/20 |
| 4,078,619 | 3/1978 | Sudnishnikov et al. | 175/19 |
| 4,648,746 | 3/1987 | Abinett | 405/154 X |

FOREIGN PATENT DOCUMENTS

| | | |
|---|---|---|
| 1392868 | 5/1975 | United Kingdom . |
| 1406769 | 9/1975 | United Kingdom . |
| 1438734 | 6/1976 | United Kingdom . |
| 1517250 | 7/1978 | United Kingdom . |
| 1522931 | 8/1978 | United Kingdom . |
| 1527343 | 10/1978 | United Kingdom . |
| 1530865 | 11/1978 | United Kingdom . |
| 1542541 | 3/1979 | United Kingdom . |
| 1554019 | 10/1979 | United Kingdom . |
| 2022169 | 12/1979 | United Kingdom . |
| 2022651 | 12/1979 | United Kingdom . |
| 1567343 | 5/1980 | United Kingdom . |
| 2049762 | 12/1980 | United Kingdom . |
| 2143561 | 2/1985 | United Kingdom . |

*Primary Examiner*—Dennis L. Taylor

*Attorney, Agent, or Firm*—Richards, Harris, Medlock & Andrews

[57] ABSTRACT

A soil displacement tool, or mole, comprises a hollow cylindrical body in which is provided an hydraulically reciprocal piston the movement of which drives the tool through the soil to form a hole, the body and piston being annular such that the tool is hollow.

12 Claims, 1 Drawing Sheet

SOIL DISPLACEMENT TOOLS

FIELD OF THE INVENTION

The present invention concerns improvements in or relating to soil displacement tools.

BACKGROUND ART

Existing soil displacement tools are normally provided to carry out relatively small diameter tunneling or piling operations. They are pneumatically driven and comprise an elongate member incorporating a cylinder arranged with its axis coincident with the longitudinal axis of the tool, a piston being caused to reciprocate and, in normal operation, strike an anvil plate at the forward end of the tool to cause the tool to move through the soil in which it is placed as a result of the impact imparted to the tool by the piston.

Such tools are wasteful in energy in that the compressed air which is fed thereto is exhausted to atmosphere from the rear of the tool. Additionally, they are relatively low on power.

They suffer from the further disadvantage that they are on many occasions lost as a result of being trapped down the hole they have produced as a result for example, of collapse of the hole behind the tool. This problem is mitigated in certain tools by providing a reversing action so that the piston is caused to impact the rear end of the tool to cause it to move in a reverse direction but this has called for relatively complicated and expensive valve gear and has not been particularly efficient.

A further disadvantage which often occurs in a piling operation is that as the tool is withdrawn from the hole it has produced the hole collapses prior to the introduction of a cementitious grout which is to be fed into the hole to produce the pile.

SUMMARY OF THE INVENTION

It is an object of the present invention to obviate or mitigate these disadvantages.

According to the present invention there is provided a soil displacement tool comprising an elongate body having a cylinder formed therein, a piston movable in the cylinder, hydraulic liquid supply and exhaust lines to the cylinder and valve means for causing the piston to selectively impact one or other end of the cylinder to move the tool.

Preferably the piston and cylinder are annular so that a central longitudinal passage may be provided through the tool.

Preferably a supply line may be connected to said central passage so that material, for example cementitious grout, may be passed through the tool as it is being withdrawn from the hole it has produced.

Preferably the valve means for reversing the action of the piston are provided on the tool, said means being actuated by a cable extending from the rear of the tool. Alternatively, reversal of the piston may be caused by the changeover of the hydraulic liquid supply and exhaust to and from the tool, remote from the tool.

Preferably a removable end cap is provided at the leading end of the tool to close off the central passage as the tool progresses, the end cap being "lost" as the tool is withdrawn. Alternatively, a one-way valve may be provided at the end of the passage.

In certain instances it may be desirable to provide a withdrawal cable extending from the rear end of the tool.

BRIEF DESCRIPTION OF THE DRAWINGS

An embodiment of the present invention will now be described, by way of example only, with reference to the accompanying drawings in which.

DETAILED DESCRIPTION

Figure 1:
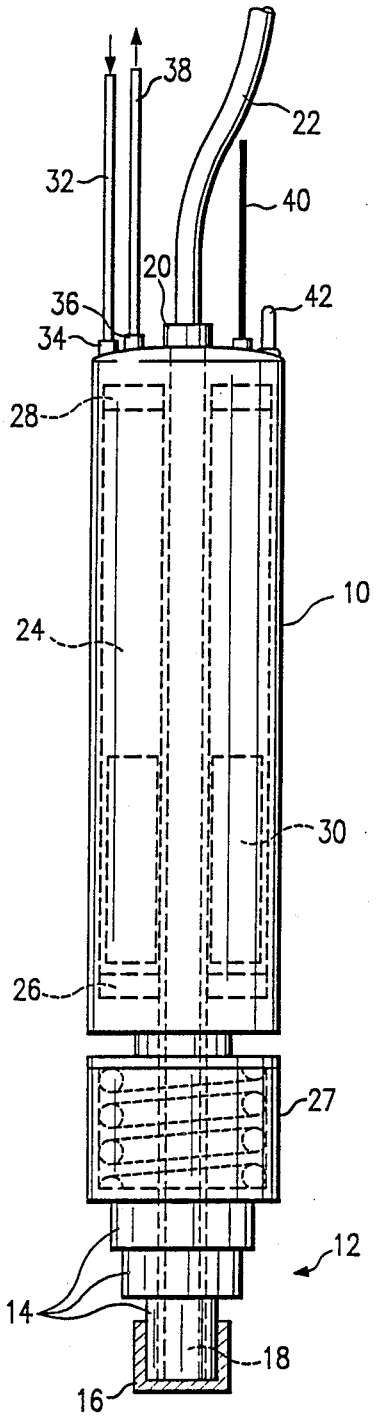
FIG. 1 shows a side elevation of a hydraulically powered soil displacement tool or mole according to the present invention.

The tool comprises a cylindrical casing 10, the forward end 12 of which is provided with stepped protrusions 14 the diameter of which reduce towards the leading end of the tool. A removable end cap 16 is fitted over the leading protrusion 14 and covers a circular cross-section passage 18 which extends through the centre of the casing 10 from the forward to the rearward end, a connection 20 being provided at the rearward end of the tool for a flexible supply line 22.

An annular cylinder 24 is formed within the casing 10 terminating at each end in forward and rearward striking plates or anvils 26, 28 adapted in use to be impacted by a reciprocable annular piston 30 provided with standard sealing rings (not shown) in the cylinder 24.

An hydraulic liquid supply line 32 leads to a connection 34 at the rearward end of the casing and, in a similar manner, an exhaust line 38 is connected to the rearward end of the casing 10 by a connection 36.

Valve gear and fluid lines, which do not form part of the present invention and consequently will not be described, are provided in the casing so that, in action, when a pressurised hydraulic fluid is supplied to the cylinder by way of the valve gear and internal lines through the supply line 32 the piston 30 is caused to reciprocate in the cylinder 24. In normal operating conditions the energy of reciprocation towards the leading end 12 of the casing is greater than the energy of return, so that impact of the cylinder 30 against the forward striking anvil 26 causes the tool to be driven through soil in which it is placed in a forward direction. The driving effect is achieved by a spring urged forward head 27 slidably mounted on the casing 10.

Preferably the valve gear in the casing incorporates reversing means whereby the piston can be caused to move towards the rear of the casing at a greater energy than its return towards the leading end of the casing so that the piston 30 impacts against the rear impact anvil 28 to cause reverse movement of the tool. This reversing valve gear may be controlled by a control cable 40 or a further hydraulic line leading from the rear of the casing. A shackle 42 may also be provided on the rear of the casing to facilitate rearward movement of the tool by a heavy duty cable 50 attached thereto.

The tool of the present invention is particularly advantageous in a piling operation where it is driven vertically into the ground or at an angle close to the vertical in a location where a pile has to be formed and when the tool has reached the desired depth it is withdrawn from the hole either by reversing the hydraulic supply thereto or by withdrawing it with the aid of a heavy duty cable. As the tool is withdrawn comentitious grout can be supplied under pressure through the flexible supply line 22 and the central passage 18 to fill the void left as the tool is withdrawn and thereby form the pile.

It will be realised, of course, that the hollow nature of the tool makes it suitable for other operations, for example for pulling cables through soil etc.

A further advantage of the machine is that the resistance to movement of the tool through the soil is in relationship to the pressure and volume of the hydraulic fluid supply to the tool to cause this movement. It is a relatively simple matter to monitor these pressure and volume conditions and to calculate a direct reading, at the surface, of the resistance being experienced by the tool and consequently the load which the pile provided in the soil to this depth will support.

Figure 2:
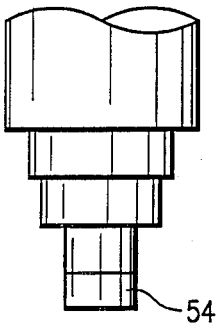
FIG. 2 is a partial side elevation of an alternative embodiment thereof.

Various modifications can be made without departing from the scope of the invention. For example, the removable end cap 16 can be replaced by a one-way valve 54, shown in the partial side elevation in the alternative embodiment of FIG. 2. The configuration of the cylinder, piston, striking plates, etc. can be modified and the hydraulic supply can be arranged in any desirable manner, for example, so that movement reversal can be achieved by reversing, at the surface, the hydraulic supply and exhaust to and from the tool.

In a modification the tool need not have a central passage, in which case the piston and cylinder will be circular in cross-section. The tool, as outlined above, can be used for piling operations in many different modes. For example it may provide the unlined passage for the pile in the manner described or a lined passage by pulling down with it pile casings, the tool being located in the forward interior end of the casing. Alternatively it may provide a lined pile by driving pile sections from above ground level. The piles may be vertical or angled.

The tool may also be used to drive small diameter horizontal or inclined tunnels and may be utilised to pull pipes behind it. It may be used to brake up existing pipes.

Whilst endeavouring in the foregoing specification to draw attention to those features of the invention believed to be of particular importance it should be understood that the Applicant claims protection in respect of any patentable feature or combination of features hereinbefore referred to whether or not particular emphasis has been placed thereon.

I claim:

1. A soil displacement tool comprising:

an elongate body having a cylinder formed therein, a piston moveable in the cylinder, fluid supply and exhaust lines in the cylinder and valve means for causing the piston to selectively impact one or other end of the cylinder to move the tool, the piston and cylinder being annular with the piston having a longitudinal bore therethrough along its longitudinal axis with a central longitudinal passage formed through the piston and through the tool.

2. A tool as claimed in claim 1, further comprising a supply line connected to said central passage so that material may be passed through the tool as it is being moved.

3. A tool as claimed in claim 1 or claim 2 wherein reversal of the piston is caused by the changeover of the hydraulic liquid supply and exhaust to and from the tool, remote from the tool.

4. A tool as claimed in claim 2 further comprising:

a removable end cap at the leading end of the tool to close off the central passage as the tool progresses, the end cap being "lost" as the tool is moved and material injected through said central passage.

5. A tool as claimed in claim 1 or claim 2 further comprising:

a withdrawal cable extending from the rear end of the tool.

6. A tool as claimed in claim 1 or claim 2, in which a withdrawal cable extends from the rear end of the tool.

7. A soil displacement tool comprising:

an elongate body having a cylinder formed therein, a piston moveable in the cylinder and having a longitudinal bore therethrough, means for causing the piston to move longitudinally in the cylinder of said body so that it selectively impacts one or the other end of the cylinder thereby causing said tool to move, a channel defined in said elongate body and positioned through the longitudinal bore of said piston, said piston being moveable relative to said channel, and means in the ends of said elongate body communicating into said cylinder and with said channel such that material may be passed into said body and through said channel and said piston from one end of the tool to the other.

8. A tool as claimed in claim 7 further comprising:

a supply line connected to said means for communicating with the end of said elongate body so that material may be passed to and through said tool.

9. A soil displacement tool according to claim 7 further comprising:

means for passing material to and through said tool as said tool is being moved.

10. A soil displacement tool comprising:

an elongate body having a cylinder formed therein, a conduit positioned within and along the longitudinal axis of the cylinder and an annular piston moveable in the cylinder relative to said conduit, means for causing the piston to move longitudinally in the cylinder of said body relative to said conduit so that it selectively impacts one or the other end of the cylinder thereby causing said tool to move.

11. A soil displacement tool according to claim 10 further comprising:

a supply line connected to said elongate body and coupled to said conduit so that material may be passed to and through said conduit and thereby to and through said tool.

12. A soil displacement tool according to claim 10 futher comprising:

means for passing material to and through said conduit in said tool as said tool is being moved.

* * * * *